US005458705A

United States Patent [19]

Mazur et al.

[11] Patent Number: 5,458,705

[45] Date of Patent: Oct. 17, 1995

[54] THERMAL CYCLING TITANIUM MATRIX COMPOSITES

[75] Inventors: Vladislav I. Mazur; Yuri N. Taran; Svetlana V. Kapustnikova, all of Dnepropetrovsk; Viktor I. Trefilov, Kiev; Sergey A. Firstov, Kiev; Leonid D. Kulak, Kiev, all of Ukraine

[73] Assignee: Ceramics Venture International Ltd., Dublin, Israel

[21] Appl. No.: 323,048

[22] Filed: Oct. 14, 1994

Related U.S. Application Data

[62] Division of Ser. No. 25,223, Mar. 2, 1993, Pat. No. 5,366, 570.

[51] Int. Cl.[6] ..... C22C 14/00

[52] U.S. Cl. ..... 148/669; 148/421; 148/670

[58] Field of Search ..... 148/421, 669, 148/670

[56] References Cited

U.S. PATENT DOCUMENTS

| | | | |
|---|---|---|---|
| 4,639,281 | 1/1987 | Sastry et al. | 148/669 |
| 4,737,341 | 4/1988 | Barber | 420/419 |
| 4,915,903 | 4/1990 | Brupbacher et al. | 420/590 |
| 4,915,904 | 4/1990 | Christodoulou et al. | 420/418 |
| 4,915,905 | 4/1990 | Kampe et al. | 420/418 |
| 5,139,585 | 8/1992 | Watanabe et al. | 148/421 |

FOREIGN PATENT DOCUMENTS

| | | |
|---|---|---|
| 0556191 | 4/1973 | U.S.S.R. . |
| 1601170 | 10/1990 | U.S.S.R. . |

OTHER PUBLICATIONS

Crossman et al , MET. Trans. 2 (1971) 1545.

Zhang et al MAT. Science & Technology, 7 (1991) 812.

Flowers et al MET. Trans. (1971) 3289.

*Primary Examiner*—Upendra Roy

[57] ABSTRACT

A titanium matrix composite having eutectically formed titanium alloy reinforcement containing at least two of the elements of silicon, aluminum, zirconium, manganese, chromium, molybdenum, carbon, iron, boron, cobalt, nickel, germanium and copper.

12 Claims, 10 Drawing Sheets

▽ - Ti - 2Si - 5.4Al - 5.3Zr - 0.8Fe

⊜ - Ti - 6.2Si - 5.4Al - 6Zr

○ - Ti - 5.3Si - 5Al

THERMAL CYCLING TITANIUM MATRIX COMPOSITES

This is a division of application Ser. No. 08/025,223, filed on Mar. 2, 1993 now U.S. Pat. No. 5,366,570.

FIELD OF THE INVENTION

The present invention generally relates to high silicon content titanium matrix composites having eutectically formed titanium-ceramic reinforcement therein and more particularly relates to high silicon content titanium matrix composites having eutectically formed titanium-ceramic reinforcement containing at least two of the elements of silicon, aluminum, zirconium, manganese, chromium, molybdenum, carbon, iron, and boron.

BACKGROUND OF THE INVENTION

Metal matrix composites of titanium base have been used for high load bearing applications such as in aircraft and high compression diesel engine parts. Ceramic materials are preferably used in these composites serving as a reinforcing element. The desirability of these metal-ceramic composites lies largely in such properties as low density, high tensile strength, high fracture resistance, high temperature stability, and low thermal conductivity.

The metal-ceramic composites retain the most desirable properties of each of its component material, i.e., the low density, low thermal conductivity, and high temperature stability properties of the ceramic and the high tensile strength and high fracture resistance properties of the metal. These metal matrix ceramic composite materials when compounded properly possess the best properties of both the component materials. To achieve the optimum properties of the metal matrix ceramic composites, the processing conditions for the alloys and the thermal cycling treatment of the alloy for dimensional stability must be carefully performed.

Numerous titanium metal composites have been proposed by others. Authors Certificate USSR 556191 to Glazunov, et al. discloses a widely used titanium composite of Ti—6Al—4V. Glazunov, et al. further discloses another composition of Ti—5.5Al—2Sn—2Zr—4.5V—2Mo—1.5Cr—0.7Fe—0.2Cu—0.2C. The tensile strength of this alloy approaches 1400 MPa while the relative elongation approaches 10%.

European patent application EP 0243056 to Barber discloses titanium-based alloys and methods of manufacturing such alloys. The base composition discloses by Barber is Ti—7Al—7Zr—2Mo—10Ge. Barber also discloses a titanium based alloy in general consisting of 5.0–7.0% aluminum, 2.0–7.0% zirconium, 0.1–2.5% molybdenum, 0.01–10.0% germanium and optionally one or more of the following elements: tin 2.0–6.0%, niobium 0.1–2.0%, carbon 0–0.1% and silicon 0.1–2.0%; the balance being titanium. It should be noted that molybdenum and germanium are two necessary elements in Barber's composition.

U.S. Pat. No. 4,915,903 to Brupbacher, et al., U.S. Pat. No. 4,195,904 to Christodoulou, and U.S. Pat. No. 4,915,905 to Kampe, et al. discloses a process for stabilization of titanium silicide particles within titanium aluminide containing metal matrix composites. While the patents cite the necessity of having zirconium present to stabilize the titanium silicide in order to prevent it from dissolving in the matrix, the titanium silicide phase is in a matrix of titanium aluminide, not titanium. The patents further suggest that titanium silicide particles would be highly unstable within a titanium environment.

Author Certificate USSR 1501170 to Mazur, et al. discloses a titanium composite containing 2.0–7.0% molybdenum, 2.0–5.0% aluminum, 4.0–8.0% silicon, and 0.5–1.5% manganese.

Crossman, et al. discloses titanium compositions containing 10% zirconium and 8% silicon. *Metallurgical Transactions,* 1971, Vol. 2, No. 6, p. 1545–1555. Crossman, et al. used induction melting and electron beam melting techniques to produce their unidirectionally solidified eutectic composites which included 7.7 volume percent of TiB and 31 volume percent of $Ti_5$ $Si_3$ fibers for reinforcement. However, the mechanical properties of Ti—10Zr—8Si were not reported.

Zhu, et al. studied the silicides phases in titanium-silicon based alloys. *Material Science and Technology,* 1991, Vol. 7, No. 9, p. 812–817. Zhu, et al. studied the distribution, type, composition, in a lattice parameters of the silicides in cast titanium alloys of Ti—4.0Si—5.0Al—5.0Zr. Zhu, et al. did not study any titanium composites containing more than 4% silicon.

Flower, et al. studied silicide precipitation in a number of martensitic titanium-silicon alloys and ternary and more complex alloys containing zirconium and aluminum. *Metallurgical Transactions,* 1971, Vol. 2, No. 12, p. 3289–3297. In titanium composites containing zirconium and aluminum, the maximum content of silicon studied was 1.0%.

Horimura discloses in Japanese patent publication 3-219035 a titanium base alloy for high strength structural materials made of 40 to 80% atomic weight titanium, 2 to 50% atomic weight aluminum, 0.5 to 40% atomic weight silicon, and 2 to 50% atomic weight of at least one of nickel, cobalt, iron, manganese, or copper.

It is therefore an object of the present invention to overcome the various drawbacks associated with the use of prior art titanium composites.

It is another object of the present invention to provide a titanium matrix composite having eutectically formed titanium-ceramic reinforcement therein.

It is yet another object of the present invention to provide a titanium matrix composite having eutectically formed titanium-ceramic reinforcement therein comprising more than 9% by weight silicon.

It is a further object of the present invention to provide a titanium matrix composite comprising titanium-based solid solution and reinforcing phases of titanium-ceramic.

It is another further object of the present invention to provide a titanium matrix composite having eutectically formed titanium alloy reinforcement therein whereby the alloy elements are selected from the group consisting of silicon, germanium, aluminum, zirconium, molybdenum, chromium, manganese, iron, boron, nickel, carbon, and nitrogen.

It is yet another further object of the present invention to provide a family of titanium matrix composites incorporating titanium matrix for its high tensile strength and high fracture resistance properties and titanium-ceramic reinforcement for its low density and low thermal conductivity properties such that the composite material has the best properties of both components.

It is still another further object of the present invention to provide a method of achieving property optimization for a titanium matrix composite having eutectically formed titanium-ceramic reinforcement therein comprising titanium, silicon, aluminum, and at least one element selected from the group consisting of zirconium, molybdenum, chromium, carbon, iron and boron by thermal cycling the composite between the temperature of 800° C. and 1020° C. for a minimum of 30 cycles.

SUMMARY OF INVENTION

The present invention is directed to novel metal matrix composites of titanium-based solid solution and reinforcing phases of titanium-ceramic compounds. The composite elements may be selected from silicon, germanium, aluminum, zirconium, molybdenum, chromium, manganese, iron, boron, nickel, carbon, and nitrogen. The silicon content may be in the amount of up to 20 weight percent, the zirconium content may be in the amount of up to 15 weight percent, the molybdenum, chromium, iron and boron may be in an amount of up to 4 weight percent, the aluminum, germanium, manganese, and nickel may be in an amount of up to 35 weight percent, while the carbon and nitrogen may be in an amount of up to 1 weight percent. The novel metal matrix composite materials may be produced by one or more of the methods like casting, granular or powder metallurgy, or a self-combustion synthesis. The metal matrix composites, if necessary, may be subjected to thermal cycling treatment to achieve its optimum properties.

The metal matrix composites of titanium base can be suitably used in high load bearing applications such as for parts used in turbine engines and in high compression diesel engines. The titanium based metal matrix composites have improved high temperature strength, wear resistance, and thermal stability in hostile environment, in combination with the desirable properties of its ceramic components such as low density and low thermal conductivity. The novel titanium based metal matrix materials also have high fracture resistance and superior creep resistance.

In one preferred embodiment of the invention, a titanium matrix composite which has eutectically formed titanium-ceramic reinforcement therein can be made with between about 9% to about 20% by weight silicon. In another preferred embodiment of the invention, a titanium matrix composite having eutectically formed titanium-ceramic reinforcement therein not containing molybdenum, may be formulated with between about 4.5% to about 20% by weight silicon. In still another preferred embodiment of the invention, a titanium matrix composite having eutectically formed titanium-ceramic reinforcement therein not containing molybdenum end zirconium, may be formulated with between about 2% to about 20% by weight silicon. In a further preferred embodiment of the invention, a titanium matrix composite having eutectically formed titanium-ceramic reinforcement therein not containing manganese can be formulated with between about 4.5% to about 20% by weight silicon.

The present invention is also directed to a method of achieving property optimization for a titanium matrix composite having eutectically formed titanium-ceramic reinforcement therein comprising titanium, silicon, aluminum and at least one element selected from the group consisting of zirconium, molybdenum, chromium, carbon, iron and boron. The method comprising carrying out a thermal cycle by depositing the composite into a first furnace preset at a temperature between about 650° to about 850° C. for a predetermined amount of time, withdrawing the composite after the predetermined amount of time from the first furnace, depositing the composite immediately thereafter into a second furnace preset at a temperature between about 920° to about 1070° C. for the predetermined amount of time, withdrawing the composite after the predetermined amount of time from the second furnace and repeating the thermal cycle for a sufficient number of times such that all metastable phases in the composite are decomposed.

BRIEF DESCRIPTION OF THE DRAWINGS

Other objects, features, and advantages of the present invention will become apparent upon consideration of the specification and the appended drawings, in which.

DETAILED DESCRIPTION OF THE PREFERRED EMBODIMENTS

In accordance with a preferred embodiment of the present invention, titanium-based metal matrix composites can be formed consisting of titanium-based solid solutions and reinforcing phases of titanium ceramic by selecting at least two alloying elements from the group consisting of silicon, germanium, aluminum, zirconium, molybdenum, chromium, manganese, iron, boron, nickel, carbon, and nitrogen. It is desirable to have a silicon content in an amount of up to 20 weight percent and a zirconium content up to 15 weight percent, the molybdenum, chromium, iron and boron content in an amount of up to 4 weight percent, the aluminum, germanium, manganese, and nickel in an amount of up to 35 weight percent, and carbon and nitrogen in an amount of up to 1 weight percent.

The principal components of our novel titanium-based metal matrix composite are selected such that the reinforcing phase of the titanium alloy solidifies during a eutectic reaction simultaneously, or consecutively with the precipitation of the titanium phase. One or more reinforcing phases may be precipitated from the molten metal to constitute a considerable volume fraction of the total alloy and thus contribute significantly to the total properties of the composite material.

These properties include, but are not limited to, high tensile strength, high toughness-to-weight ratio, high temperature resistance, high fracture strength, high thermal stability in hostile environment, low density, and low thermal conductivity.

Figure 1A:
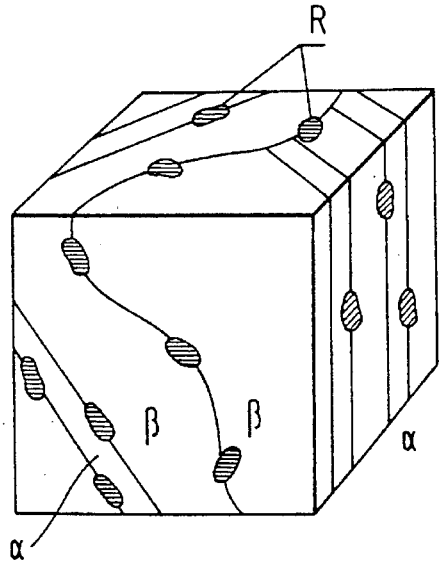
FIG. 1 is a schematic representation of the structure of (a) a prior art commercial titanium alloy, (b) a present invention eutectically formed titanium alloy containing rod-like reinforcement, and (c) a present invention of eutectically formed titanium alloy containing lamellar-like reinforcement.
Figure 1B:
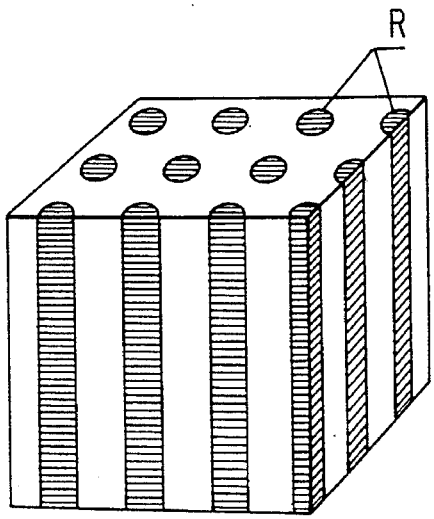
Figure 1C:
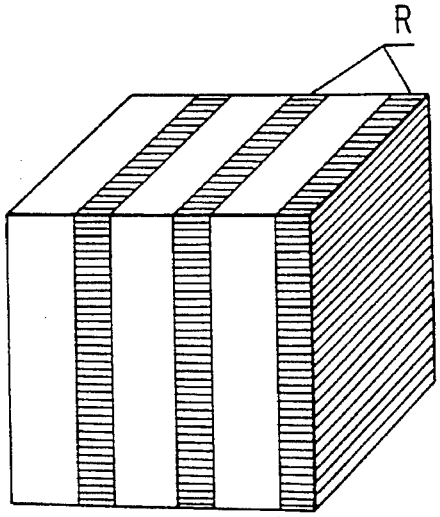

It was discovered that an alloy may be strengthened through control of alpha-to-beta-titanium volume ratio by the adjustment of alpha and/or beta stabilizer amounts and through the alloying of alpha and beta-solid solution with various hardening elements. When presented in small amounts, these hardening elements may be completely dissolved in a titanium-base solid solution. However, when the amounts exceed a respective solubility limit, reinforcing phase precipitates mainly on the grain boundaries and in the phase boundaries. This is shown in FIG. 1(*a*). These precipitates add to the strength and high temperature resistance of the material but in some cases, impair the plasticity and the fracture toughness of the composites.

It was also discovered that there is a major group of titanium-based alloys in which greater amounts of alloying elements result in a new mechanism of reinforcing phase formation that is different than the precipitation process. In these alloys, the reinforcing phase forms in solidification either simultaneously with beta-titanium or after crystallization of the beta-titanium. This is called a eutectic freezing process and the alloys whose composition is such that a eutectic reaction occurs in them are called eutectic-type alloys.

When the volume fraction of the reinforcing phase is large enough, a eutectic type alloy may have unique new service properties not found in commercial alloys. These new and improved properties can be attributed to the formation of a special structure of high-strength rods or lamellae of the reinforcing phase. These rods or lamellae are shown in FIGS. 1(*b*) and 1(*c*). When these high strength rods or lamellae are distributed within the ductile titanium matrix, the properties of the titanium matrix are greatly improved. These eutectically formed alloys differ from conventionally manufactured composites in that their structure forms during the solidification process of the melt in a so-called in-situ formation. These in-situ composites have further benefits of simplicity and cost-effectiveness in their manufacturing process. A small disadvantage of these high-alloyed eutectic titanium alloys is that their strength and plasticity in the low through medium temperature range is not as good as other commercial alloys. This is a result of a high volume fraction (20% to 60%) of the high strength, low-ducility reinforcing phase such as boride, intermetallic compound or silicide. However, at higher temperature ranges of above 600° C., these eutectic type alloys show superior properties.

We have also discovered that the plasticity at low temperatures may be improved by the optimal alloying of the eutectic composites. For instance, the plasticity may be improved by the synthesis of smaller thickness of rods or lamellae and their reduced spacing in the eutectic alloy. This provides an effect similar to that observed with reducing the diameter of a glass rod, i.e., when the glass rod has a diameter of one centimeter it is brittle while a glass filament of 0.001 centimeter in diameter is elastic.

The experimental methods of the present invention are described as follows: melting was effected in a non-consumable skull induction furnace with water-cooled copper-graphite crucible and argon atmosphere, double electron-beam remelting unit, electroslag remelting unit with argon atmosphere, or crucibleless induction furnace with magnetic levitation in argon atmosphere. Ingots were used for the preparation of specimens employed in metallographic, physical and chemical studies as well as in mechanical tests.

Figure 2A:
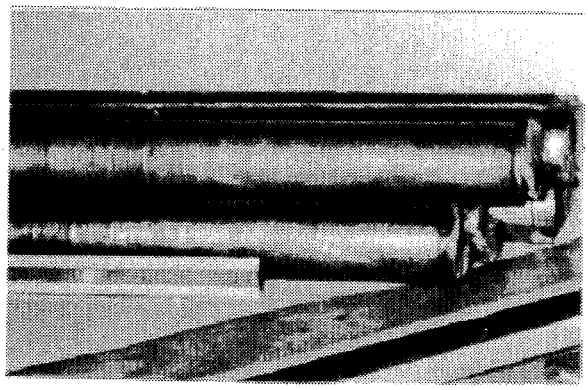
FIG. 2 are photographs showing bars and blanks of permanent-mold castings of (a) bars 55 mm in diameter, (b) blanks for cylinder and piston parts of an engine, and (c) blanks for a turbine motor.
Figure 2B:
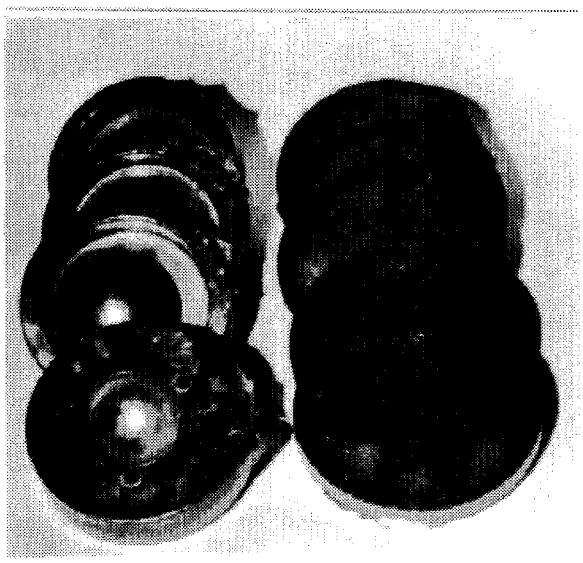
Figure 2C:
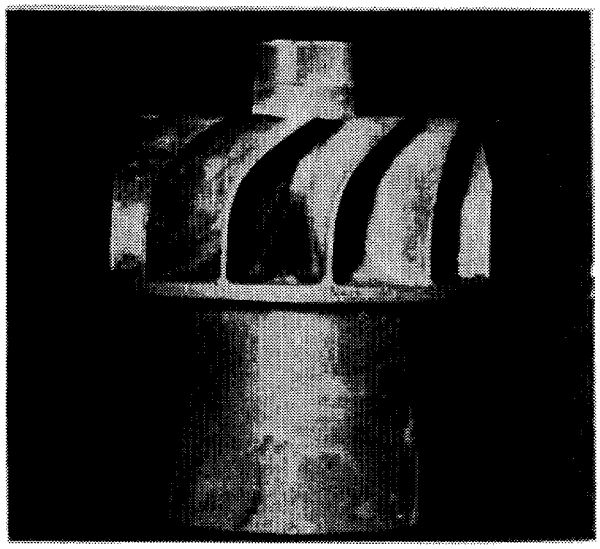
Figure 3A:
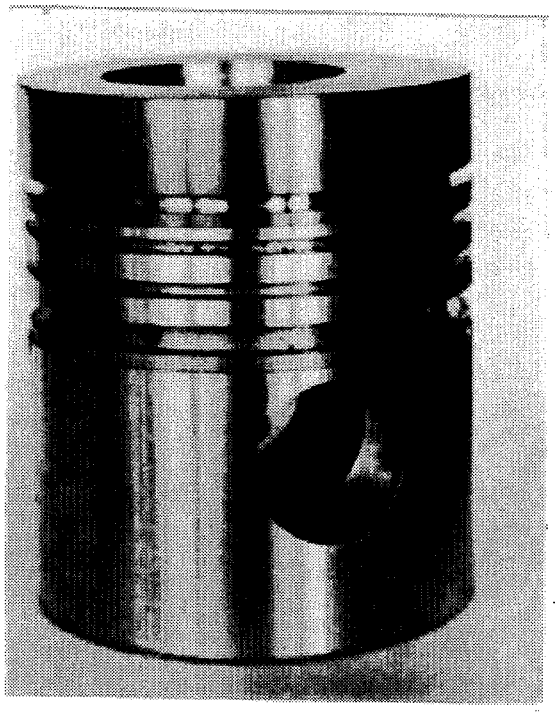
FIG. 3 are photographs showing cylinder and piston parts for a diesel engine before test (a) and after test (b, c and d).
Figure 3B:
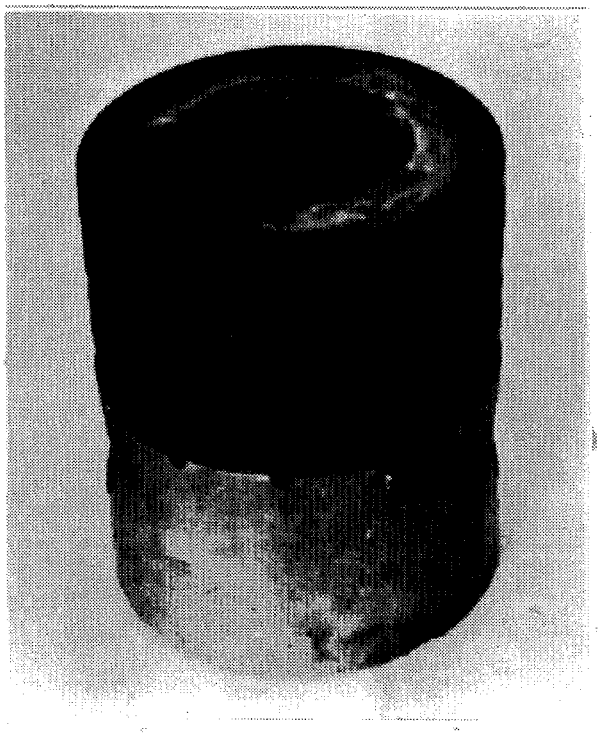
Figure 3C:
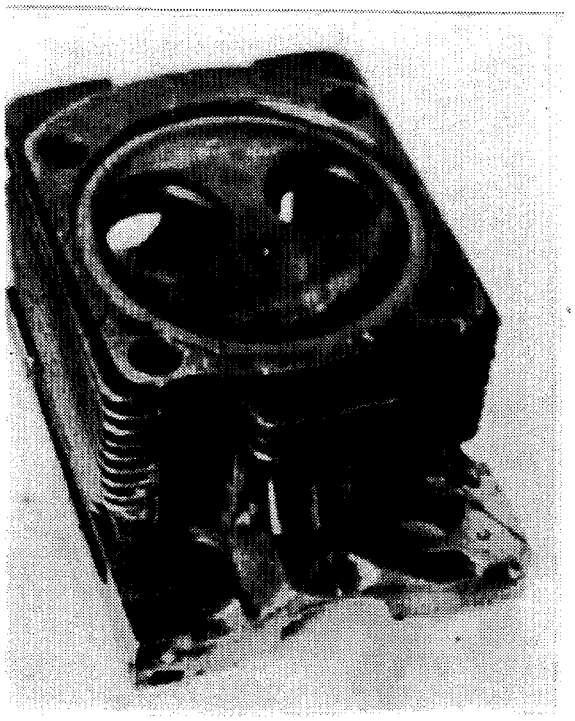
Figure 3D:
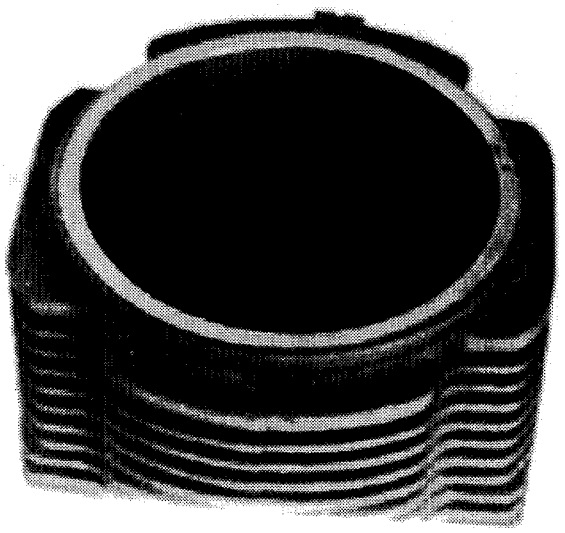

Also tested were blanks for cylinder and piston parts of diesel engines. These bars and blanks of permanent-mold castings are shown in FIG. 2. In some cases, bars 55 mm. in diameter and 700 mm. in length were cast in metallic or graphite molds to be further remelted and rapidly solidified.

Figure 4A:
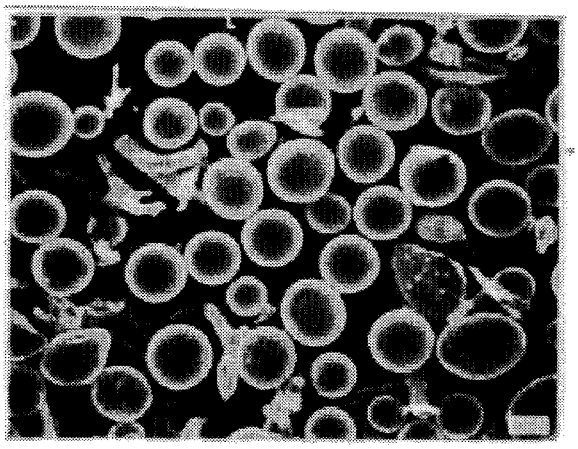
FIG. 4 are photo micrographs (50×) showing (a) spherical and (b) flaky particles of rapidly solidified metal/ceramic material.
Figure 4B:
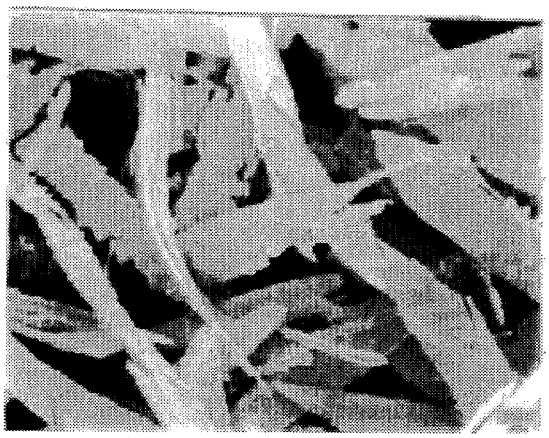

Sintered alloys were produced from spherical or flaky granules or from powders prepared by spinning atomization in which the end of a rotating bar 55 mm. in diameter was melted by plasma heating in an atmosphere of argon or helium gas. FIG. 3 are photographs showing cylinder and piston parts for a diesel engine before test (a) and after test (b, c and d). FIG. 4 are photo micrographs (50×) showing (a) spherical and (b) flaky particles of rapidly solidified titanium matrix composites.

The following composite systems were prepared, Ti—Al, Ti—Si, Ti—Zr, Ti—Si—Al, Ti—Si—Zr, Ti—Al—Mn, Ti—Si—Al—Zr, Ti—Si—Al—Mn, Ti—Si—Al—Fe, Ti—Si—Al—Zr—Mn, Ti—Si— Al—Cr—Mo, Ti—Si—Al—Mn—Fe, Ti—Si—Al—Zr—Fe, Ti—Si—Al—Zr—Mo, Ti—Si—Al—Mn—C, Ti—Si— Al—Mn—Zr—Fe, Ti—Si—Al—Cr—Mo—Fe, Ti—Si—Al—Zr—Cr—Mo, Ti—Si—Al—Zr—Cr—Mo—B, Ti—Si—Al—Mn—Cr—Mo—Fe.

Samples prepared were subjected to a series of mechanical tests. The first test performed was a thermal stability test or the oxidation resistance test of the alloys. Resistance to high-temperature gaseous attack in hostile environment is one of the most important performance properties of structural materials for use in high temperature environments.

To determine the effect of alloying elements on the oxidation resistance of titanium matrix composites, four series of samples were prepared. These include binary systems of Ti—Al, Ti—Si, and Ti—Zr, ternary systems of Ti—Al—Mn, Ti—Si—Al, and Ti—Si—Zr, quaternary system of Ti—Si—Al—Zr and more complex alloys such as Ti—Si—Al—Mn—Cr—Mo were also prepared to compare to a base material of silicon nitride $Si_3N_4$.

The samples were prepared by crucibleless melting with magnetic levitation method in an atmosphere of argon gas. The oxidation resistance was determined by continuous measuring of weight gain of a sample placed inside a vertical resistance furnace with an oxidizing atmosphere. The furnace temperature was controlled with a high precision temperature regulator. The deviation of furnace temperature was found to be within ±7° C. Tests were conducted at 700°, 800°, and 950° C. for 25 hours.

TABLE 1

Oxidation Rate for Experimental alloys at 950° C., in mg/(cm$^2$ h)

| | Alloy Composition | Rate |
|---|---|---|
| 1 | Ti-7Al | 1.60 |
| 2 | Ti-10Si | 1.48 |
| 3 | Ti-7Zr | 1.25 |
| 4 | Ti-3Al-1Mn (commer. mat. OT-4) | 3.45 |
| 5 | Ti-10Si-7Zr | 0.52 |
| 6 | Ti-10Si-7Al | 0.57 |
| 7 | Ti-2Si-5.4Al-5.3Zr-0.6Fe | 0.60 |
| 8 | Ti-3.5Si-4.3Al-6.2Zr | 0.41 |

TABLE 1-continued

| Oxidation Rate for Experimental alloys at 950° C., in mg/(cm$^2$ h) | | |
|---|---|---|
| | Alloy Composition | Rate |
| 9 | Ti-5.5Si-5.4Al-7.2Zr | 0.55 |
| 10 | Ti-6Si-4.5Al-4Zr-0.3Fe | 0.25 |
| 11 | Ti-6.2 Si-5.4Al-6Zr | 0.23 |
| 12 | Ti-9Si-5Al-6Zr | 0.18 |
| 13 | Ti-10Si-7Al-7Zr | 0.10 |
| 14 | Ti-4.2Si-2Al-2Mn-2.5Cr-2.3Mo-1.5Fe | 1.23 |
| 15 | Ti-6.6Si-5.6Al-5.4Zr | 0.12 |
| 16 | Ti-3Si-6Al-9.6Zr-0.3Fe | 0.19 |
| | $Si_3N_4$ | 0.20 |

The weight gain rate data for various alloy compositions at 950° C. is shown in Table 1. Compositions 1 through 6 and $Si_3N_4$ are shown for comparison purposes and are not part of the present invention. It is seen that binary, ternary and five component alloys have unsatisfactory oxidation resistance. Quaternary composites Ti—Si—Al—Zr which have at least 6% Si compared favorably in their weight gain rate at 950° C. with $Si_3N_4$ ceramic materials. The best oxidation resistant material is observed in the sample of Ti—10Si—7Al—7Zr composite. We believe that the alloy has a large volume fraction of eutectically formed phase of $Ti_5Si_3$ which has superior resistance to high temperature oxidation.

The second mechanical test performed on the titanium metal matrix composites was a fracture toughness test. The suitability of a material for service under dynamic and impact loads is generally determined by its value of the fracture toughness. Single three-point bending tests were performed by using square bar specimens with a straight, or a V-like notch in a high temperature test unit. The specimen size utilized was 42×7.5×5 mm.

Figure 5:
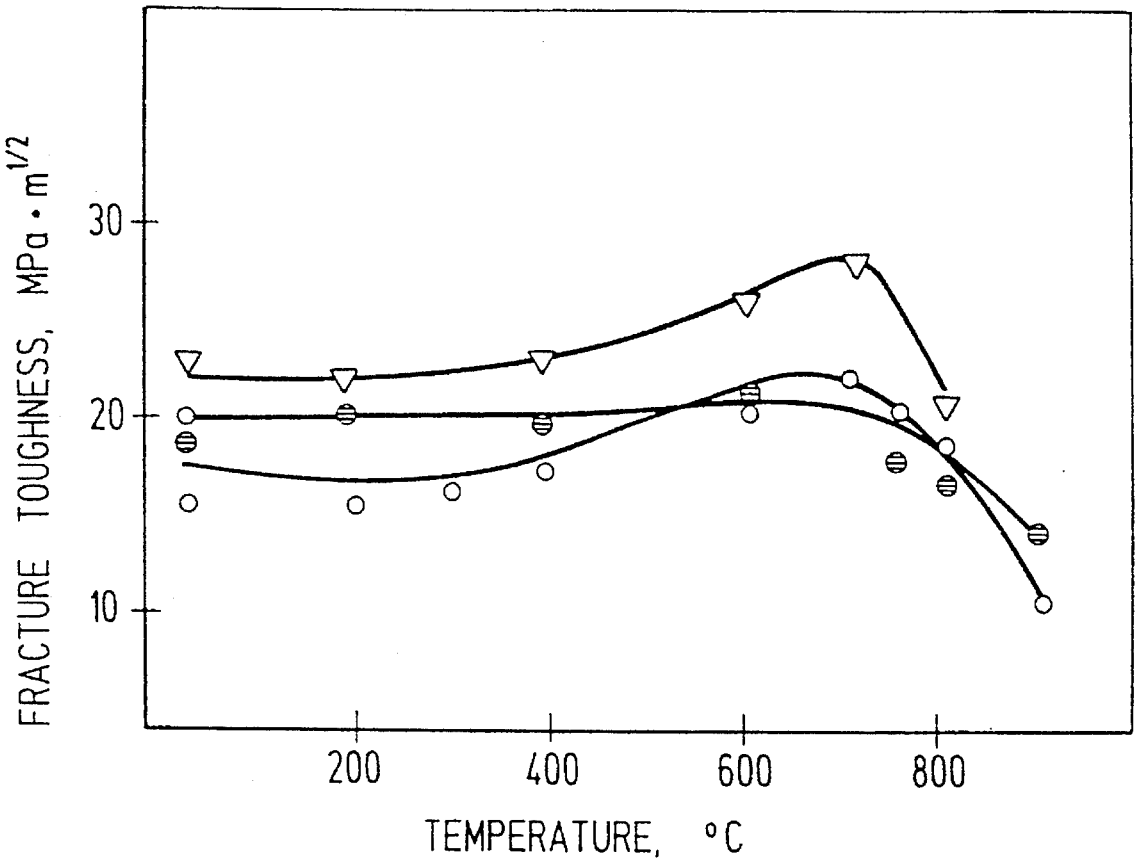
FIG. 5 is a graph showing the fracture toughness as a function of temperature for present invention Ti—Si—Al—Zr composites.

FIG. 5 shows three curves for the fracture toughness as a function of temperature for several composites. Comparing commercial titanium alloys where the fracture toughness continuously decreases with the increasing temperature, the titanium matrix composites show the increase of fracture toughness in the temperature range of 600–700 degrees C. The Ti—6.2Si—5.4Al—6Zr composite, where the content of silicon is higher, is distinguished by higher fracture toughness at 900 degrees C. This is especially important for materials used in applications such as pistons or turbine blades. It is seen that these composites in contrast to commercial titanium alloys, display improved fracture toughness values over the temperature range of 600°–750° C. It should be noted that even at higher temperatures the fracture toughness maintains its fairly high values. This is especially important for materials used in applications such as pistons or turbine blades.

TABLE 2

| Influence of cast alloy composition on fracture toughness Kic at various temperatures, in MPa m$^{1/2}$ | | | |
|---|---|---|---|
| | Kic at | | |
| Alloy Composition | 20° C. | 800° C. | 900° C. |
| 1 Ti-5Al (commer. mat. Vt-5) | 40.0 | — | — |
| 2 Ti-4Si-2.5Al-4Zr | 14.2 | 11.1 | 5.0 |
| 3 Ti-5Si-4Al-0.8Mn | 17.0 | 14.5 | 15.0 |
| 4 Ti-4.2Si-4.5Al-2.5Cr-2.3Me-0.1Fe | 20.1 | 11.4 | 4.7 |
| 5 Ti-3Si-6Al-9.6Zr-0.35Fe | 18.2 | 18.0 | 10.8 |
| 6 Ti-6Si-4Al-4Zr-2.5Me | 18.5 | 10.9 | 5.8 |
| 7 Ti-6.6Si-5.6Al-5.4Zr | 16.9 | 14.3 | 8.9 |
| 8 Ti-2.8Si-6.4Al-12.4Zr-0.8Fe | 14.5 | 15.1 | 13.6 |
| 9 Ti-5.3Si-5Al | 19.5 | 17.9 | 9.5 |
| 10 Ti-4.7Si-4.4Al-9.4Zr | 20.1 | 12.6 | 11.1 |
| 11 Ti-2Si-5.4Al-5.3Zr-0.6Fe | 21.5 | 17.8 | — |
| 12 Ti-6.2Si-5.4Al-6Zr | 18.5 | 16.0 | 15.0 |

Figure 6:
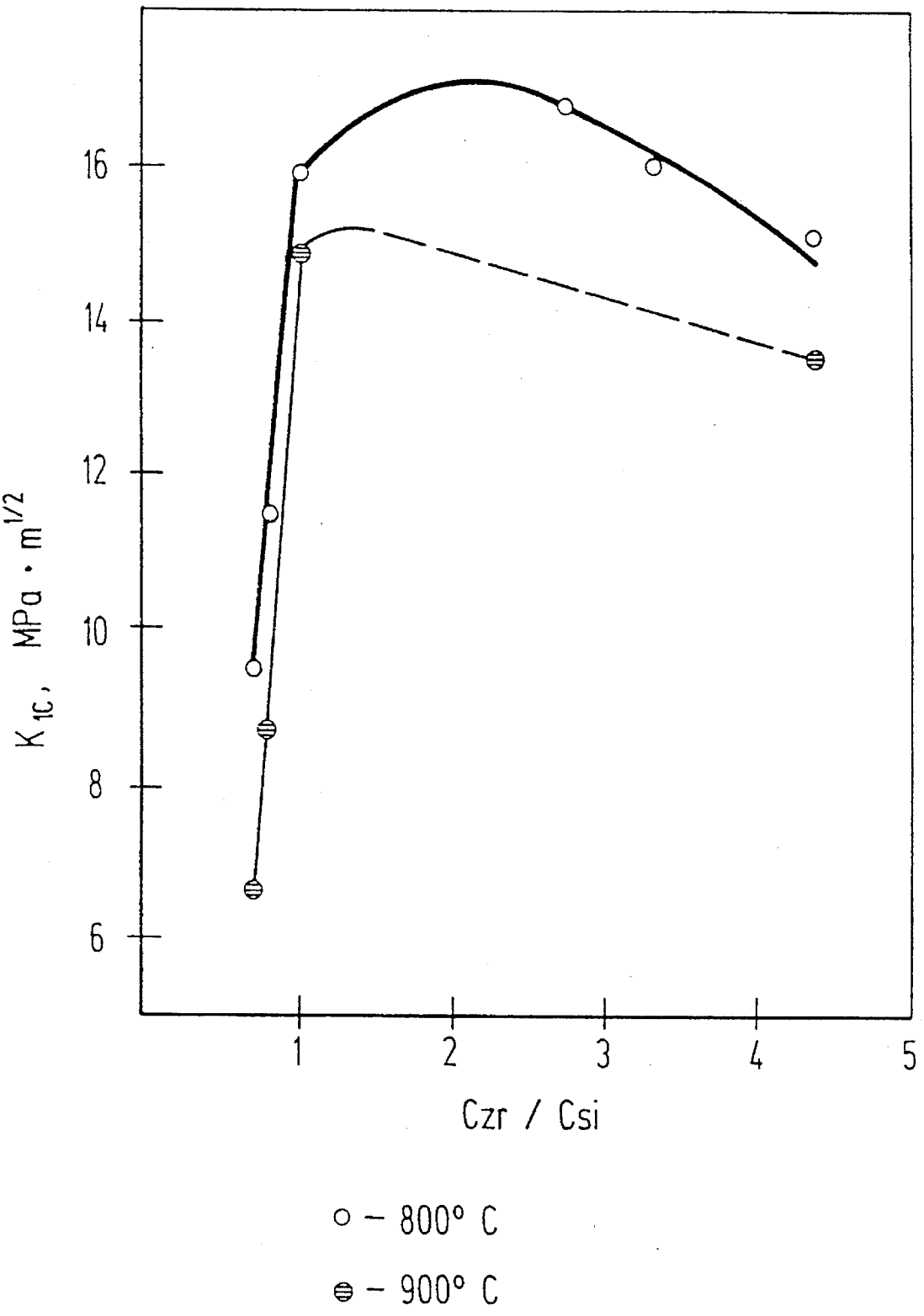
FIG. 6 is a graph showing the fracture toughness of Ti—Si—Al—Zr composites as a function of the composition ratio between zirconium and silicon.
Figure 7A:
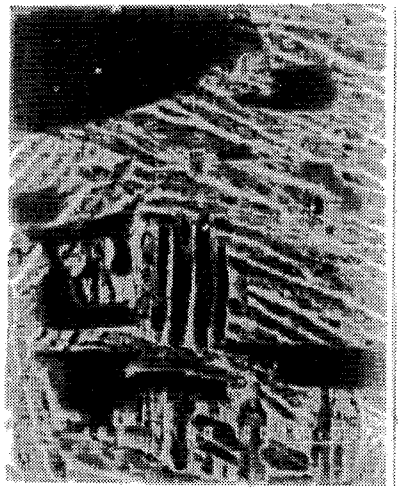
FIG. 7 are sem micrographs (1000×) showing the distribution of alloying elements in titanium silicide, (a) micrograph obtained using secondary electrons, (b) micrograph obtained using characteristic Si K(alpha) X ray radiation, and (c) micrograph obtained using characteristic Zr K alpha) X ray radiation.
Figure 7B:
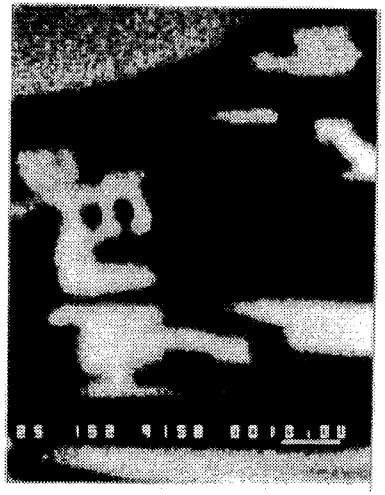
Figure 7C:
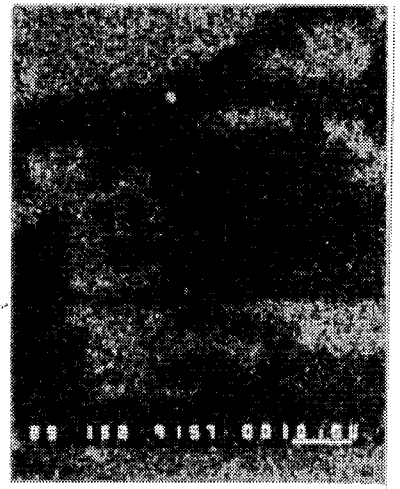

Table 2 shows the fracture toughness values for eleven alloys at three different temperatures. The effects of alloy compositions on the fracture toughness are fairly complex. In FIG. 6, where the fracture toughness value is plotted against a ratio of zirconium to silicon, it shows that acceptable fracture toughness values are obtained when the ratio is greater or equal to one. We believe that this behavior can be explained as follows. The main reinforcing phase that provides the composite with the required high temperature properties is $Ti_5Si_3$ which is rather brittle. When alloyed with zirconium, zirconium solid solution in titanium silicide forms to bring about an improvement in the mechanical properties. This is shown in FIG. 7. We believe that the role of manganese in Ti—5Si—4Al—0.8Mn alloy is similar to that of zirconium. From Table 2, it is seen that the maximum fracture toughness values at 800°–900° C. is obtained with the compositions of Ti—6.2 Si—5.4 Al—6Zr and Ti—5Si—4Al—0.8Mn. Table 2 also shows that the maximum values for the fracture toughness is obtained at 800° C. when Zr/Si is about 2. The same was obtained at 900° C., when Zr/Si is approximately 1. It is seen that composites according to the present invention have greater resistance to cracking than $Si_3N_4$ base ceramic material whose fracture toughness value is between 5 to 7 MPa m$^{1/2}$.

TABLE 3

| Influence of chemical composition on tensile strength and relative elongation of experimental composites at various temperatures | | | | | | | |
|---|---|---|---|---|---|---|---|
| | Tensile MPa Strength | | | | Elongation, % | | |
| Composition, wt. % | 20° C. | 600° C. | 700° C. | 900° C. | 20° C. | 600° C. | 900° C. |
| 1 Ti-0.7Si-3.2Al-1.3Mn | 723 | 293 | 135 | 75 | 11.5 | 11.6 | 44.0 |
| 2 Ti-9.5Si-3Al-0.7Mn-0.4C | 381 | — | 380 | 120 | 1.3 | 2.0 | 6.0 |
| 3 Ti-4Si-2Al-1Mn | 600 | 670 | 405 | 230 | 1.5 | 2.0 | 6.0 |
| 4 Ti-4.2Si-2Al-2Mn-2.5Cr-2.3Me-1.5Fe | 650 | 630 | 600 | 140 | 1.0 | 2.5 | 25.0 |
| 5 Ti-7Si-2.5Al-0.2Mn | 566 | 470 | 325 | 200 | 2.1 | 2.0 | 13.0 |
| 6 Ti-4.8Si-3Al | 505 | 380 | — | 280 | 1.9 | 1.5 | 7.0 |

TABLE 3-continued

Influence of chemical composition on tensile strength and relative elongation of experimental composites at various temperatures

| Composition, wt. % | Tensile MPa Strength | | | | Elongation, % | | |
|---|---|---|---|---|---|---|---|
| | 20° C. | 600° C. | 700° C. | 900° C. | 20° C. | 600° C. | 900° C. |
| 7 Ti-4.5Si-3Al-4.5Zr | 609 | 460 | 450 | 260 | 2.3 | 1.7 | 9.0 |
| 8 Ti-5.2Si-4.2Al-0.8Mn-0.3Fe | 673 | 610 | 430 | 250 | 2.3 | 1.2 | 4.0 |
| 9 Ti-5.2Si-5.7Al-0.3Fe | 638 | — | 530 | 330 | 2.6 | 1.7 | 2.5 |
| 10 Ti-6Si-4.6Al-4Zr-0.3Fe | 566 | 510 | 490 | 300 | 1.6 | 1.0 | 3.5 |
| 11 Ti-5.3Si-5Al-1Mn | 638 | 550 | 520 | 290 | 2.7 | 1.0 | 3.5 |
| 12 Ti-4.2Si-4.5Al-2.5Cr-2.3Me-0.1Fe | 571 | 590 | 390 | 190 | 2.1 | 1.5 | 16.0 |
| 13 Ti-5.8Si-4.3Al-4Zr-3.7Cr-2.6Me-0.01B | 710 | 620 | 500 | 210 | 2.0 | 2.0 | 12.0 |

The third mechanical test performed is for tensile strength and relative elongation at break. The tensile strength and the relative elongation at break are two important properties of structural composites since they represent the capacity to withstand loads over a wide temperature range. Data contained in Table 3 illustrates how chemical compositions of experimental alloys affects their tensile strength and relative elongation at various temperatures. These data are compared with similar values for a commercial titanium alloy.

At room temperature, commercial titanium alloys have better strength than the titanium composites disclosed in the present invention. However, the advantages of the commercial alloys diminishes with increasing temperature and that at temperatures of 600° C. and above, composites in the present invention show superior tensile strength. We believe this is due to the considerable volume fraction, i.e., 30%–40% of the reinforcing silicide phase.

At medium temperature ranges, i.e., 600°–700° C., maximum tensile strength values were obtained with Ti—4Si—2Al—1Mn and Ti—4.2Si—2Al—2Mn— 2.5Cr—2.3Mo—1.5Fe composites. The latter material also showed improved plasticity at 800° C.

At a higher temperature range of 800° C., Ti—5.2Si—5.7Al—0.3Fe, Ti—6Si— 4.6Al—4Zr—0.3Fe and Ti—5.3Si—5Al—1Mn composites have maximum tensile strength. We believe this is a result of the greater amounts of silicon which forms $Ti_5Si_3$ and also of the alloying of the silicide with iron or manganese.

It should be noted that Ti—4.2Si—2Al—2Mn—2.5Cr—2.3Mo—1.5Fe, Ti—7Si— 2.5Al—0.2Mn, Ti—4.2Si—4.5Al—2.5Cr—2.3Mo—0.1Fe and Ti—5.8Si—4.3Al—4Zr—3.7Cr—2.6Mo—0.01B composites have shown improved relative elongations at 800° C. This positive effect results from the complex alloying of the silicide phase with manganese, chromium, and molybdenum and further, in the latter alloy, from the presence of boron which modifies the composite structure.

The fourth mechanical test we have performed on our titanium matrix composite is a creep hardness determination. Creep hardness test is considered an important property for materials to be utilized in high temperature service environment. The data obtained in the creep hardness test are shown in Table 4.

TABLE 4

Creep hardness, HV, of experimental composites at various temperatures, in MPa

| Composition, wt. % | Creep hardness, MPa | | | |
|---|---|---|---|---|
| | 20° C. | 500° C. | 700° C. | 850° C. |
| 1 Ti-5Al (commer. mat. VT-5) | 3800 | 1520 | 370 | 125 |
| 2 Ti-10Si | 6000 | 1610 | 310 | 60 |
| 3 Ti-7Al | 3600 | 1920 | 1020 | 280 |
| 4 Ti-10Si-7Al | 5800 | 3040 | 850 | 180 |
| 5 Ti-10Si-7Zr | 5500 | 1430 | 460 | 200 |
| 6 Ti-8.5Si-7Al | 6000 | 3210 | 970 | 160 |
| 7 Ti-5Si-5Al-7Zr | 7000 | 2300 | 390 | 80 |
| 8 Ti-7.7Si-2.5Al-0.1Mn | 3650 | 1340 | 340 | 130 |
| 9 Ti-4.8Si-3Al-0.1Mn | 3800 | 1980 | 430 | 160 |
| 10 Ti-4Si-2.7Al-0.2Mn-4Zr | 3150 | 1850 | 650 | 170 |
| 11 Ti-5.2Si-4.2Al-0.8Mn-0.3Fe | — | 1430 | 510 | 160 |
| 12 Ti-6Si-4.6Al-4Zr-0.3Fe | 3960 | 1720 | 480 | 190 |
| 13 Ti-4.2Si-4.5Al-2.5Cr-2.3Mo-0.1Fe | 3800 | 1530 | 330 | 60 |
| 14 Ti-3.4Si-6Al-0.3Mn-9.6Zr-0.3Fe | 3150 | 1370 | 360 | 140 |
| 15 Ti-5.8Si-4.3Al-4Zr-3.7Cr-2.6Mo-0.01B | 3800 | 1330 | 290 | 70 |
| 16 Ti-5Si-4.8Al-3.9Zr | 3840 | 1610 | 480 | 100 |
| 17 Ti-6.6Si-5.6Al-5.4Zr | 4000 | 2100 | 650 | 230 |
| 18 Ti-2.8Si-6.4Al-12.4Zr-0.8Fe | 3730 | 2560 | 970 | 240 |
| 19 Ti-5.3Si-5Al | 5010 | 1660 | 480 | 100 |
| 20 Ti-4.7Si-4.4Al-9.4Zr | 4800 | 3250 | 1160 | 280 |
| 21 Ti-5.5Si-5.4Al-7.2Zr | 5600 | 3650 | 1080 | 300 |
| 22 Ti-9Si-5Al-6Zr | — | 4000 | 1600 | 590 |

Figure 8A:
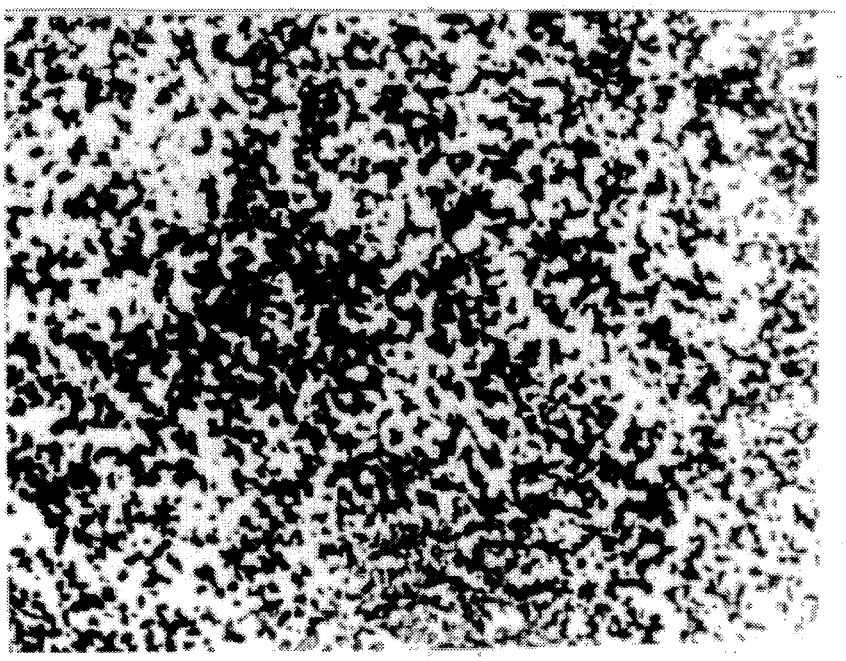
FIG. 8 are photo micrographs (500×) showing composites produced by (a) self-combustion synthesis, and (b) permanent mold casting.
Figure 8B:
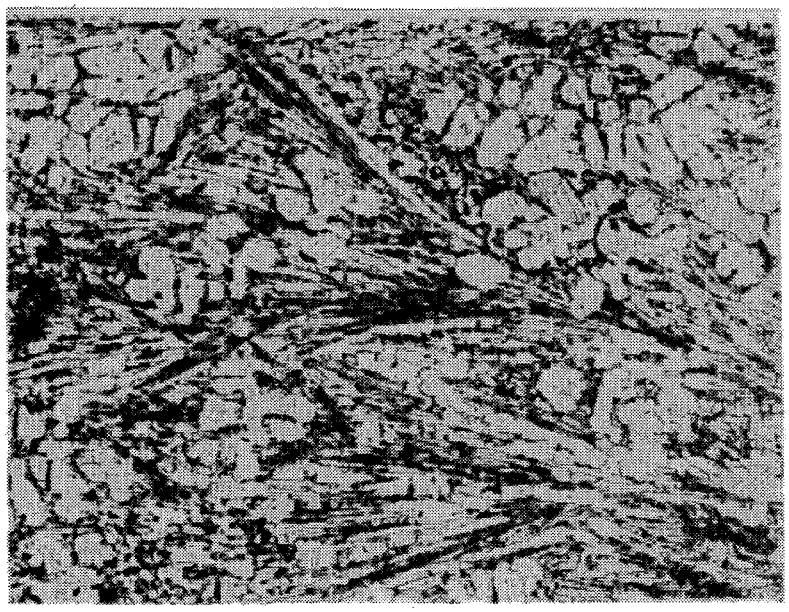

Table 4 shows creep hardness data for the titanium composites at 20°, 500°, 700° and 850° C. It is noticed that a maximum creep hardness value at 850° C. is obtained by the composite Ti—9Si—5Al—6Zr which contains high silicon and zirconium elements. Sufficiently high creep hardness values (280–300 MPa) were also obtained by Ti—4.7Si—4.4Al—9.4Zr and Ti—5.5Si—5.4Al—7.2Zr. We believe this is caused by the relatively high content of aluminum in the alloys and a greater amount of eutectic silicide. This is shown in FIG. 8*a* where the dark shaded areas indicate silicide particles and the light shaded areas indicate titanium matrix. FIG. 8*b* shows silicide crystals arranged in fan-like manner in titanium matrix.

Different processing methods may also result in different creep hardness performance. We have discovered that composites molten by electron beam process show higher creep hardness than those produced by induction melting of levitated samples. The reason lies in that the latter contain a smaller amount of eutectic constituents and the silicide eutectic dendrite has thinner branches in them.

The last mechanical test we have performed is a flexural strength determination. The flexural strength or bending strength value is a characteristic that represents capacity of a material to withstand fracture where the state of stress is more complex than tension. High temperature flexural strength is also an important property for materials to be used in a high load and high temperature environment.

TABLE 5

Flexural strength of experimental alloys at various temperatures, MPa

| Composition wt. % | Flexural strength 20° C. | 400° C. | 600° C. | 700° C. | 800° C. |
|---|---|---|---|---|---|
| 1 Ti-5Al (VT-5) | 1290 | 690 | 525 | — | — |
| 2 Ti-2.8Si-6.4Al-12.4Zr-0.8Fe | 860 | 810 | 720 | 590 | 330 |
| 3 Ti-5.3Si-5Al | 600 | 800 | 800 | 560 | 300 |
| 4 Ti-2Si-5.4Al-5.3 Zr-0.6Fe | 450 | 720 | 650 | 430 | 245 |
| 5 Ti-6.2Si-5.4Al-6Zr | 1020 | 1100 | 900 | 720 | 400 |

Table 5 shows temperature dependence of flexural strength for our titanium metal matrix composites compared to conventional titanium alloy of VT5. At 20° C., VT5 has an obvious advantage over the present invention titanium composites, however, at elevated temperatures, the present invention produces alloys having much superior properties.

At the highest test temperature of 800° C., Ti—6.2Si—5.4Al—6Zr has the best flexural strength of 400 MPa. Ti—5.3Si—5Al and Ti—2.8Si—6.4Al—12.4Zr—0.8Fe also show improved flexural strength of between 300 to 330 MPa. We believe that the strength of the reinforcing phase plays an important role in addition to the strength of the titanium matrix material. The strength of the reinforcing phase depends largely on the volume fraction of $Ti_5Si3$ which is determined by the amounts of silicon and zirconium and further on the zirconium content in the silicide.

The effect of different processing techniques on the properties of the titanium matrix composites was also studied. Presently, the world production of titanium alloys in castings relies mainly on the use of vacuum in arc, induction and electron beam furnaces. Equipment using inert atmosphere is less common. Production facilities are therefore complex in design and require large areas, and it is difficult to improve productivity or reduce costs.

In recent years a new process for manufacture of materials has been developed and commercialized, namely, a self-combustion synthesis. With this process, the primary components of titanium and nitrogen gas are situated in a chamber preset at a certain pressure. A chemical reaction is started in a small volume in the chamber, for instance, by heating a tungsten wire through which an electric current is passed. The heat generated during the chemical reaction of the synthesis heats the adjoining portions of the reagents which then join the process until the primary components are totally consumed. Titanium nitride forms as a result of solid-phase titanium burning in an atmosphere of nitrogen.

A self-combustion synthesis of Ti matrix composites was conducted by the following procedure. The charged components were blended in a mixer and briquetted at a pressure of 100 MPa using a hydraulic press. The briquettes were placed in an electric muffle furnace at a temperature of 850°–1000° C. As soon as a temperature of 830° C. was reached by the briquette, reactions of $Ti_5Si_3$ and $Ti_3Al$ synthesis started causing a rise in temperature up to 1900°–2000° C. The original shape of the briquette was retained despite the fact that results of eutectic melting has occurred in the briquette. When the briquette is cooled down to 1000°–1100° C., it is moved to a die for final compaction and shaping.

A close examination of a micrograph obtained on the reaction products shows that unlike the cast composite structure, the self-combustion sample contains conglomerate type eutectic structure. This is because during solidification the eutectic liquid was subjected to considerable undercooling resulting from its great overheating during the synthesis reactions.

Powder metallurgy was also utilized in the present invention to provide the required phase composition and fine structure of materials, and further avoiding dendritic and zone segregation and coarse aggregates of undesirable phases.

A promising state-of-the-art process of powder metallurgy is rapid solidification of powder with a further compacting step. It provides materials having practically 100% density and very fine structure and thus ensures an improvement in their mechanical properties.

Original billets produced by electron beam melting were machined to obtain a diameter of 50 min. and a length of 700 min. A billet was fixed in a machine for atomization by melting-off in rotation. The billet face was heated with a plasma beam generated from a 9:1 helium-argon gas mixture. The rotational speed of the billet was varied over the range of 800 to 5000 revolutions per minute.

The cooling rate of the molten liquid was between 100° to 10,000° C./second in a gas atmosphere, and between 1000° to 1,000,000° C./second when splattered on a water-cooled metal plate. In the first cooling method, spherical particles 30 to 800 micrometers in size were formed, while flakes 20 to 80 micrometers in thickness were formed in the second cooling method.

TABLE 6

Chemical composition of powder ceramic-metal composites, in wt %

| | Si | Al | Zr | Fe | Ti |
|---|---|---|---|---|---|
| 1 | 2.0 | 5.4 | 5.3 | 0.6 | Balance |
| 2 | 6.2 | 5.4 | 6.0 | — | Balance |
| 3 | 6.7 | 5.7 | 5.7 | — | Balance |

The powder composition is given in Table 6. The powder was placed in a graphite die, subjected to induction heating to 1000° to 1400° C., held for 10 minutes and then compacted at a pressure of 75 MPa.

TABLE 7

Temperature dependence of flexural strength of Ti-6.7Si-5.7Al-5.7Zr powder composite

| Compacting temperature, °C. | Flexural strength, MPa 20° C. | 300° C. | 500° C. | 700° C. | 800° C. |
|---|---|---|---|---|---|
| 900 | 150 | 312 | 230 | 180 | 130 |
| 1200 | 230 | 380 | 560 | 620 | 550 |
| 1300 | 190 | 543 | 827 | 651 | 234 |

The effect of pressing temperature on the flexural strength of Ti—6.7Si—5.7Al—5.7Zr powder composite is shown in Table 7 at various flexural test temperatures. It is seen that compacting in a range of 1200° to 1300° C. provides improved strength properties. This was because plasticity of beta-Ti in the composite matrix is improved. It was also ascertained that Ti—2Si—5.4Al—5.3Zr—0.6Fe and Ti—6.2Si—5.4Al—6Zr composites acquired similar properties when compacted at 1150° and 1250° C. respectively.

TABLE 8

Temperature dependence of properties of Ti-2Si-5.4Al-5.3Zr-0.6Fe composites

| | 20° C. | 200° C. | 400° C. | 500° C. | 600° C. | 700° C. | 800° C. |
|---|---|---|---|---|---|---|---|
| | | | Cast material | | | | |
| Flexural strength, MPa | 430 | 550 | 720 | — | 850 | 410 | 340 |
| Kic, MPa $m^{1/2}$ | 20 | 20 | 21.4 | 20 | 24 | 27 | 16.5 |
| HV, MPa | — | — | — | 1980 | — | 430 | 100 |
| | | | Compacted powder material | | | | |
| Flexural strength, MPa | 500 | 750 | 900 | — | 1000 | — | 200 |
| Kic, MPa $m^{1/2}$ | 20 | 21 | 22 | — | 26 | 28 | 16 |
| HV, MPa | — | — | — | 2230 | — | 330 | 100 |

TABLE 9

Temperature dependence of properties of Ti-6.2Si-5.4Al-6Zr composites

| | 20° C. | 200° C. | 300° C. | 400° C. | 500° C. | 600° C. | 700° C. | 800° C. | 900° C. |
|---|---|---|---|---|---|---|---|---|---|
| | | | | Cast material | | | | | |
| Flexural strength, MPa | 1040 | 1120 | — | 1120 | — | 975 | 760 | 414 | |
| Kic, MPa $m^{1/2}$ | 18 | 19 | — | 18 | — | 19.5 | 16 | 17 | 15 |
| f, mm | 0 | 0 | — | 0 | — | 0 | 0 | 0.78 | — |
| HV, MPa | — | — | — | — | 3880 | — | 1610 | 900 | — |
| | | | | Compacted powder material | | | | | |
| Flexural strength, MPa | 200 | — | 380 | — | 430 | — | 600 | 450 | 250 |
| Kic, MPa $m^{1/2}$ | 14 | 11 | — | 18 | 19 | 25.5 | 29 | 34 | 33 |
| f, mm | 0 | — | 0 | — | 0 | — | 0.18 | 0.2 | 90° bend angle |
| HV, MPa | — | — | — | — | 3540 | — | 1520 | 850 | — |

Tables 8 and 9 show the influence of fabrication process of certain properties of Ti—2Si—5.4Al—5.3Cr—0.6Fe and Ti—6.2Si—5.4Al—6Zr compositions at various test temperatures.

Data in Tables 8 and 9 show that the compacted and cast compositions of Ti—2Si—5.4Al—5.3Zr—0.6Fe alloy are similar in properties. Due to the greater amount of silicon in Ti—6.2Si—5.4Al—6Zr composite, its compacted composition is much superior in property than the cast composite in fracture resistance, especially in the temperature range between 800° to 850° C.

It was also discovered that hot forming of powder materials, when carried out at a large degree of deformation, provides strong compacted materials having improved structure and better physical, mechanical and service properties as compared with sintered or hot-pressed powders.

Powders shown in Table 7 were placed in a metallic capsule 29 mm. in diameter, prepressed at a pressure of 500–600 MPa to a density of at least 70% and sealed in a capsule. The capsule was then placed in a resistance furnace, held for 30 minutes at a temperature of 1000° C. and subjected to extrusion at a degree of deformation of 80%.

The mechanical properties of Ti—2Si—5.4Al—5.3Zr—0.6Fe composites are shown in Table 10. It is obvious that improvement in strength and flexural resistance as compared with a cast or sintered alloy samples was achieved resulting from the finer grains and the silicide particles.

TABLE 10

Temperature dependence of properties of hot-extruded Ti-2Si-5.4Al-5.3Zr-0.6Fe composite

| | 20° C. | 200° C. | 300° C. | 400° C. | 500° C. | 600° C. | 650° C. | 800° C. |
|---|---|---|---|---|---|---|---|---|
| Flexural strength, MPa | 1480 | 1280 | — | 1040 | — | 670 | — | 200 |
| Kic, MPa $m^{1/2}$ | 43 | 43 | — | 44 | — | 48 | 53 | — |
| f, mm | 1.2 | 1.2 | — | 1.2 | — | 90° bend angle | — | 90° bend angle |
| HV, MPa | — | — | — | — | — | 2000 | 290 | 110 |

The temperature dependence of fracture toughness for the cast, compacted, and extruded composites of Ti—6.2Si—5.4Al—6Zr are shown in Table 11. It is noticed that at lower test temperatures, the fabrication process does not affect the fracture toughness of the composites. At intermediate temperatures, the extruded composite has a maximum fracture toughness. At higher temperatures, the compacted composite has the highest values for fracture toughness.

TABLE 11

Influence of fabrication process on Kic for Ti-6.2Si-5.4Al-6Zr composite at various temperatures, in MPa $m^{1/2}$

| Composite type | 200° C. | 400° C. | 500° C. | 600° C. | 700° C. | 800° C. | 900° C. |
|---|---|---|---|---|---|---|---|
| Cast | 20 | 19 | 19 | 19.5 | 13–19 | 17 | 15 |
| Compacted | 12 | 18 | 19 | 25.5 | 28.5 | 34.4 | 33.5 |
| Extruded | 20 | 24 | 28.5 | 32 | 28 | 22 | — |

The effect of heat treatment by thermal cycling of the composites was also investigated. The service of components in heat engines like internal combustion engines, gas turbines, etc., involves multiple heating to the operating temperature with subsequent cooling to the ambient temperature. This thermal cycling is accompanied by high frequency variations of temperature resulting from the engine's running cycle. Such temperature variations cause complex stress conditions in the components, and in some cases, can even cause phase transformations in alloys.

It is therefore desirable to use compositions for such heat engine fabrications in which minimal or no phase transformations will occur during the component service life. It was found that phase transformation in the composite alloys can result from several processes. For instance, a supersaturated solid solution unmixing accompanied by precipitation of proeutectoid phases. It may also result from dissolution of non-equilibrium phases at low temperatures. Phase transformations in the alloys may also be caused by the spheroidization and coalescence of dendrite branches belonging to the finely ramified reinforcing phase of eutectic origin.

It is therefore desirable to have all the processes completed before the net shape machining by using thermal treatment processes to stabilize the shape and dimensions of high temperature components.

We have treated the titanium composites by the following various thermal treatment methods.

1. Isothermal annealing: 900° C., 4 hours holding, air cooling.

2. Stepped annealing: 900° C., 4 hours holding, furnace cooling to 650° C., 2 hour holding, air cooling.

3. Stepped annealing: 900° C., 3 hours holding, furnace cooling to 650° C., 0.5 hour holding, air cooling.

4. Thermal cycling between 970° and 700° C.: 150 cycles, each involving transfer of specimens between the two furnaces set at the respective temperatures. The holding time in each furnace was 0.5 hours.

5. Thermal cycling between 1020° and 800° C.: 150 cycles.

It is believed the following phase constituents are present in the primary cast composite alloys: alpha and beta-Ti, silicides $Ti_5Si_3$ and $(Ti,Zr)_5$ $(Si,Al)_3$, and other intermetallic compounds such as $Ti_3Al$.

In isothermal annealing, the structural changes involve unmixing of supersaturated solid solutions and eutectoid reaction alpha→beta+$Ti_5Si_3$. The silicides precipitated from the supersaturated solid solutions are randomly distributed within the alpha-matrix grains. Silicides of eutectoid origin form groups of parallel lamellae. No changes in the structure of eutectoid silicides were observed. The annealing was accompanied by a reduction in hardness from 50.6 to 49.4 $HR_c$.

In the stepped annealing process, phase transformations are less pronounced than in the isothermal annealing. The degree of eutectoid reaction advancement being lower and the amount of secondary silicides being smaller.

It was discovered that the thermal cycling heat treatment as defined in numbers 4 and 5 above are proven to be the most effective for our novel titanium matrix composites. The thermal cycling heat treatment according to number 4 is quite similar to what is experienced in the service of a piston in an internal combustion engine. The thermal cycling in method 5 involves a temperature range in which complete transformation between the alpha phase and the beta phase of titanium matrix occurs.

Figure 9A:
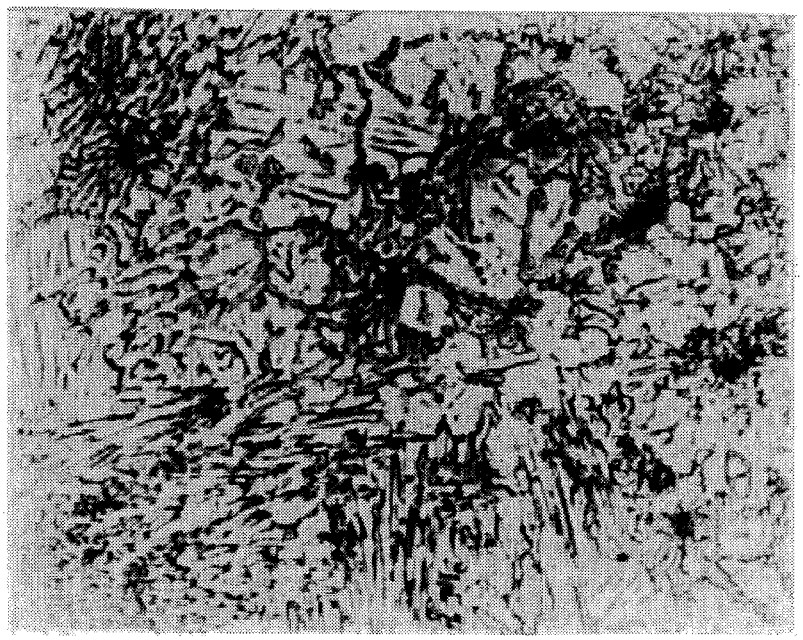
FIG. 9 are photo micrographs (500×) showing composites in (a) as-cast condition, and (b) heat-treated by thermal cycling between 1020° C. and 800° C. for 150 cycles.
Figure 9B:
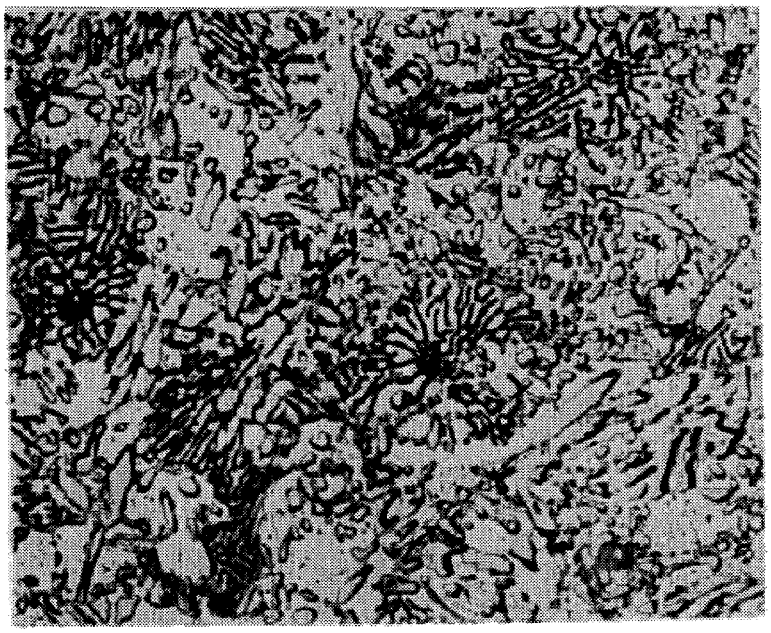

It is believed that in thermal cycling treatment 4 and 5, eutectoid reactions, unmixing of supersaturated solid solution of alloying elements in titanium matrix, silicide dendrite granulation, spheroidization and coalescence go on intensively in the matrix system. In thermal cycling heat treatment method 5, after 40 cycles no interlayers of non-equilibrium beta-phase were observed in the grains of alpha-matrix. The silicides of eutectoid origin also become coarse and sparsely distributed in the matrix grains. This is shown in FIG. 9 where photo micrographs show composites in (a) as-cast condition, and (b) heat-treated by thermal cycling between 1020° C. and 800° C. for 150 cycles. After 120 cycles, an increase in the silicide grain size is observed while other structural features remain unchanged.

We have therefore arrived at the conclusion that after 35 cycles of thermal treatment according to method number 5, an acceptable minimum of structural changes is provided which ensures the necessary level of stability of shape and dimensions.

This conclusion was further confirmed in experimental tests in which pistons of a diesel engine were tested. Changes in diameter measured between reference points on the piston top at various directions showed significant improvement in the dimensional stability. An 80% reduction in the dimensional change was observed.

The titanium matrix metal composites formulated by the present invention which have the best service properties are shown in Tables 12 and 13. Composites having the best oxidation resistance property, fracture toughness, tensile strength, elongation at break, creep hardness and flexural strength are shown in Table 12. Samples shown in Table 12 were obtained by casting method.

TABLE 12

| | Chemical composition of cast titanium-matrix ceramic composites having best service properties | | | | | | |
|---|---|---|---|---|---|---|---|
| | Oxidation resistance 0.1–0.25 mg per $cm^2 \cdot h$ | Kic at 800 to 900° C. 14.5–16.0 MPa by $m^{1/2}$ | TS at 600 to 700° C. 600–670 MPa | TS at 800° C. 290–330 12–MPa | El. at 800° C. 600 25% | Creep HV at 850° C. 280–300–MPa | Flexural strength 800° C. 400 MPa |
| Ti-10Si-7Al-7Zr | x | | | | | | |
| Ti-6.2Si-5.4Al-6Zr | x | x | | | | | x |
| Ti-5.2Si-4.2Al-0.8Mn-0.3Fe | | x | | | | | |
| Ti-4Si-2Al-1Mn | | | x | | | | |
| Ti-4.2Si-2Al-2Mn-2.5Cr-2.3Mo-1.5Fe | | | x | | x | | |
| Ti-5.2Si-5.7Al-0.3Fe | | | | x | | | |
| Ti-6Si-4.5Al-4Zr-0.3Fe | x | | | x | | | |
| Ti-5.3Si-5Al-1Mn | | | | x | | | |
| Ti-7Si-2.5Al-0.2Mn | | | | | x | | |
| Ti-4.2Si-4.5Al-2.5Cr-2.3Mo-0.1Fe | | | | | x | | |
| Ti-5.8Si-4.3Al-4Zr-3.7Cr-2.6Mo-0.01B | | | | | x | | |
| Ti-9Si-5Al-6Zr | x | | | | | x | |
| Ti-5.5Si-5.4Al-7.2Zr | | | | | | x | |
| Ti-4.7Si-4.4Al-9.4Zr | | | | | | x | |
| Ti-2.8Si-5.4Al-12.4Zr-0.8Fe | | | | | | | x |

TABLE 13

| | Chemical composition of powder titanium-matrix ceramic composites having best service properties | | | | |
|---|---|---|---|---|---|
| | Kic at 800 to 900° C. 35–33 MPa $m^{1/2}$ | Kic at 500 to 600° C. 43–48 MPa $m^{1/2}$ | El. at 800° C. 15% | Creep HV at 850° C. 210 MPa | Flexural strength at 800° C. 550 MPa |
| Ti-6.2Si-5.4Al-6Zr Hot pressing at 1300° C. | x | | | | |
| Ti-2Si-5.3Zr-5.4Al-0.6Fe Extrusion at 1000° C. | | x | | | |
| Ti-2Si-5.3Zr-5.4Al-0.6Fe Hot pressing | | | x | | |
| Ti-6.7Si-5.7Zr-5.1A Hot pressing | | | x | | |
| Ti-6.2Si-5.4Al-6Zr Hot pressing | | | | x | |
| Ti-6.7Si-5.7Zr-5.7Al 0.08Mn Hot pressing at 1200° C. | | | | | x |

Composite samples obtained by powder metallurgy are shown in Table 13 for their best fracture strength, elongation at break, creep hardness, and flexural strength.

Other group VIII metals such as nickel, cobalt, group IB metal such as copper and group IVA element such as germanium may also be used as suitable alloying elements in the present invention.

While this invention has been described in an illustrative manner, it should be understood that the terminology used is intended to be in the nature of words of description rather than of limitation.

Furthermore, while this invention has been described in terms of a few preferred embodiments, it is to be appreciated that those skilled in the art will readily apply these teachings to other possible variations of the invention.

The embodiments of the invention in which an exclusive property or privilege is claimed or defined as follows:

1. A method of achieving property optimization for a titanium matrix composite having eutectically formed titanium-ceramic reinforcement therein comprising titanium, silicon, aluminum and at least one element selected from the group consisting of zirconium, molybdenum, chromium, carbon, iron and boron, said method comprising carrying out a thermal cycle by (a) depositing said composite into a first furnace preset at a temperature between about 750° to about 850° C. for a predetermined amount of time, (b) withdrawing said composite after said predetermined amount of time from said first furnace, (c) depositing said composite immediately thereafter into a second furnace preset at a temperature between about 970° to about 1070° C. for said predetermined amount of time, (d) withdrawing said composite after said predetermined amount of time from said second furnace, and (e) repeating said thermal cycle for a sufficient number of times until all metastable phases in said composite are decomposed.

2. The method according to claim 1 wherein said sufficient number of times for said thermal cycle is 30.

3. The method according to claim 1 wherein in step (e) said sufficient number of times for said thermal cycle is at least 35.

4. The method according to claim 1 wherein said predetermined amount of time in said thermal cycle is from 0.5 to 4 hours.

5. The method according to claim 3 wherein said sufficient number of times for said thermal cycle is from 35 to 150.

6. The method according to claim 4 wherein said predetermined amount of time in said thermal cycle is 0.5 hours.

7. A method of achieving property optimization for a titanium matrix composite having eutectically formed titanium-ceramic reinforcement therein comprising titanium, silicon, aluminum and at least one element selected from the group consisting of zirconium, molybdenum, chromium, carbon, iron and boron, said method comprising carrying out a thermal cycle by (a) depositing said composite into a first furnace preset at a temperature between about 650° to about 750° C. for a predetermined amount of time, (b) withdrawing said composite after said predetermined amount of time from said first furnace, (c) depositing said composite immediately thereafter into a second furnace preset at a temperature between about 920° to about 1020° C. for said predetermined amount of time, (d) withdrawing said composite after said predetermined amount of time from said second furnace, and (e) repeating said thermal cycle for a sufficient number of times until all metastable phases in said composite are decomposed.

8. The method according to claim 7 wherein said sufficient number of times for said thermal cycle is 30.

9. The method according to claim 7 wherein in step (e) said sufficient number of times for said thermal cycle is at least 35.

10. The method according to claim 7 wherein said predetermined amount of time in said thermal cycle is from 0.5 to 4 hours.

11. The method according to claim 9 wherein said sufficient number of times for said thermal cycle is from 35 to 150.

12. The method according to claim 10 wherein said predetermined amount of time in said thermal cycle is 0.5 hours.

* * * * *